US005853503A

United States Patent [19]

Seto et al.

[11] Patent Number: 5,853,503

[45] Date of Patent: Dec. 29, 1998

[54] HOT ROLLED STEEL SHEETS AND METHOD OF PRODUCING THE SAME

[75] Inventors: Kazuhiro Seto; Kei Sakata; Osamu Furukimi; Takashi Obara, all of Chiba, Japan

[73] Assignee: Kawasaki Steel Corporation, Kobe, Japan

[21] Appl. No.: 817,947

[22] PCT Filed: Aug. 30, 1996

[86] PCT No.: PCT/JP96/02455

§ 371 Date: Apr. 28, 1997

§ 102(e) Date: Apr. 28, 1997

[87] PCT Pub. No.: WO97/08355

PCT Pub. Date: Mar. 6, 1997

[30] Foreign Application Priority Data

Aug. 31, 1995 [JP] Japan ..... 7-222874

[51] Int. Cl.[6] ..... C21C 8/00; C22C 38/04; C22C 38/06

[52] U.S. Cl. ..... 148/320; 148/330; 148/602; 148/661

[58] Field of Search ..... 148/320, 330, 148/602, 661

[56] References Cited

FOREIGN PATENT DOCUMENTS 3-56639A 3/1991 Japan .
A-4-238620 8/1992 Japan .
B2-6-104853 12/1994 Japan .
A-7-70649 3/1995 Japan .
A-7-207339 8/1995 Japan .
A-7-268456 10/1995 Japan .

*Primary Examiner*—Deborah Yee
*Attorney, Agent, or Firm*—Oliff & Berridge, PLC

[57] ABSTRACT

After a starting material of steel comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt % and the balance being Fe and inevitable impurities is heated above $AC_3$ point, rough rolling is completed within a temperature range of ($Ar_3$ point+100° C.)–($Ar_3$ point+50° C.), and super-high pressure descaling is carried out under conditions satisfying a jetting pressure of not less than 25 kgf/cm$^2$ and a liquid quantity density of not less than 0.002 liter/cm$^2$, and subsequently finish rolling at a rolling reduction of not less than 80% above $Ar_3$ point of a rolling completion temperature is started in 5 seconds and coiling is carried out below 700° C., whereby hot rolled steel sheets having a surface roughness Ra of not more than 0.8 $\mu$m and an average scale thickness of not more than 4 $\mu$m is produced and the adhesion property in case of subjecting to shaping at a mill scale state and the pickling efficiency in case of applying to pickling are improved.

6 Claims, 2 Drawing Sheets

HOT ROLLED STEEL SHEETS AND METHOD OF PRODUCING THE SAME

TECHNICAL FIELD

The present invention relates to hot rolled steel sheets, particularly steel sheets as-rolled alone or further cold rolled and a method of producing the same, and more particularly to a hot rolled steel sheet having such a thin scale that the peeling of scale is less in the working as a mill scale (as-rolled), while the pickling efficiency is good in applications after the pickling and a surface roughness Ra is not more than 0.8 μm and an average scale thickness is not more than 4 μm, and a method of producing the same.

BACKGROUND ART

In general, the hot rolled steel sheets are produced by hot rolling a slab of steel obtained through a continuous casting method or a blooming method. In a surface layer of the thus obtained hot rolled steel sheet is created so-called secondary scale produced during the hot rolling and comprised of three layers of FeO—$Fe_3O_4$—$Fe_2O_3$ having a thickness of about 5 μm~15 μm.

When the secondary scale created on the surface of the hot rolled steel sheet is subjected to a shaping work at a mill scale state (at a state of holding the mill scale on the surface of the hot rolled steel sheet), a part of the scale is peeled off to contaminate the working line, or the peeled scale induces a surface defect of a product after the work as an indentation flaw. For this end, a slightly light degree of the working has hitherto been conducted to the hot rolled steel sheet having the mill scale.

Under the above circumstance, when such the hot rolled steel sheet is subjected to a work at a large strain amount or is used as a starting material for cold rolled steel sheet, it is necessary to attempt the removal of the scale through a pickling step. Even in this case, when a coiling temperature after the hot rolling is rendered into a high temperature above 550° C. from the reason of the material properties in the conventional technique, there are problems that the scale existing on the edge of the steel sheet thickly grows, and the transformation from FeO to $Fe_3O_4$+Fe is caused to densify the scale and hence the pickling efficiency is lowered to considerably increase the load to the work line.

In order to mitigate the aforementioned problems exerting on the scale, therefore, there have been attempted some efforts for thinning the scale.

For example, JP-B-6-104853 discloses a method wherein steel containing Si: 0.02–0.2% and Cr: 0.02–0.2% is soaked to 1150° C. and the rolling at a rolling reduction of not less than 90% is started at not higher than 1000° C. and terminated at not higher than 860° C. and then the coiling is carried out at not higher than 500° C.

As a method of removing scale in the course of the hot rolling, for example, JP-A-4-238620 discloses a method wherein when hot rolled steel sheets are manufactured by subjecting a kind of steels creating hardly peelable scale to hot rolling, descaling is carried out by jetting a high-pressure spraying water onto the surface of the steel sheet at a jetting pressure per unit area of 20–40 g/mm$^2$ and a flowing quantity of 0.1–0.2 liter/min·mm$^2$ prior to a finish rolling.

However, there is a problem that the above method of JP-B-6-104853 is not applicable to a kind of steel requiring a coiling temperature of higher than 500° C. from a viewpoint of the material because it restricts the coiling temperature after the hot rolling to not higher than 500° C.

In the method of JP-A-4-238620, a greater part of scale is removed, but there is a problem that in case of a kind of steel containing a great amount of Si, scale of a structure entering into matrix is created and can not be removed and hence scale flaw called as red scale is caused after the rolling. And also, this method has a problem that it is not necessarily enough to provide the thin scale.

Moreover, only the steel sheets having a surface roughness Ra of about 1–3 μm are obtained by these conventional techniques, so that when they are subjected to forming work at the mill scale state, sufficient formability (slidability) and adhesion property are not obtained, while when they are used after the pickling, there is a problem that the pickling property is obstructed.

It is, therefore, an object of the invention to provide hot rolled steel sheets without the above-described problems involved in hot rolled steel sheet scale and a method of producing the same.

It is another object of the invention to provide a method of advantageously producing a thin-scale hot rolled steel sheet by applying a super-high pressure descaling.

It is a further object of the invention to provide hot rolled steel sheets having a thin scale at an average scale thickness of not more than 4 μm and a surface roughness (Ra) of not more than 0.8 μm without causing troubles on workability and pickling efficiency as a mill scale state even if the coiling temperature is high or if a greater amount of Si is included as well as a method of producing the same.

DISCLOSURE OF THE INVENTION

The inventors have mainly noticed the descaling conditions prior to finish rolling in order to achieve the above objects and made various studies and found that the scale properties of the steel sheet surface can largely be improved by applying super-high pressure descaling, which has never been used in the conventional technique, in order to realize the objects, and as a result the invention has been accomplished. That is, (1) The invention is a hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt % and the balance being Fe and inevitable impurities, and having a surface average scale thickness of not more than 4 μm and a surface roughness (Ra) of not more than 0.8 μm.

(2) The invention is a hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt %, one or two of Ti: not more than 0.10 wt % and Nb: not more than 0.10 wt % and the balance being Fe and inevitable impurities, and having a surface average scale thickness of not more than 4 μm and a surface roughness (Ra) of not more than 0.8 μm.

(3) The invention is a hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt %, B: not more than 0.0100 wt % and the balance being Fe and inevitable impurities, and having a surface average scale thickness of not more than 4 μm and a surface roughness (Ra) of not more than 0.8 μm.

(4) The invention is a hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01– 0.10 wt %, N: not more than 0.020 wt %, one or two of Ti: not more than 0.10 wt % and Nb: not more than 0.10 wt %, B: not more than 0.0100 wt % and the balance being Fe and inevitable impurities, and having a surface average scale thickness of not more than 4 $\mu$m and a surface roughness (Ra) of not more than 0.8 $\mu$m.

(5) The invention is a method of producing a hot rolled steel sheet, which comprises heating a starting material of steel comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt % and the balance being Fe and inevitable impurities to not lower than $Ac_3$ point, completing rough rolling within a temperature range of ($Ar_3$ point+100° C.)~($Ar_3$ point+50° C.), conducting super-high pressure descaling under conditions satisfying a jetting pressure of not less than 25 kgf/cm$^2$ and a liquid quantity density of not less than 0.002 liter/cm$^2$, starting finish rolling at a rolling reduction of not less than 80% above $Ar_3$ point of rolling complete temperature within 5 seconds and coiling up below 700° C.

(6) The invention is a method of producing a hot rolled steel sheet, which comprises heating a starting material of steel comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt %, one or more of Ti: not more than 0.10 wt %, Nb: not more than 0.10 wt % and B: not more than 0.0100 wt % and the balance being Fe and inevitable impurities to not lower than $Ac_3$ point, completing rough rolling within a temperature range of ($Ar_3$ point+100° C.)~($Ar_3$ point+50° C.), conducting super-high pressure descaling under conditions satisfying a jetting pressure of not less than 25 kgf/cm$^2$ and a liquid quantity density of not less than 0.002 liter/cm$^2$, starting finish rolling at a rolling reduction of not less than 80% above $Ar_3$ point of rolling complete temperature within 5 seconds and coiling up below 700° C.

BEST MODE FOR CARRYING OUT THE INVENTION

Figure 1:
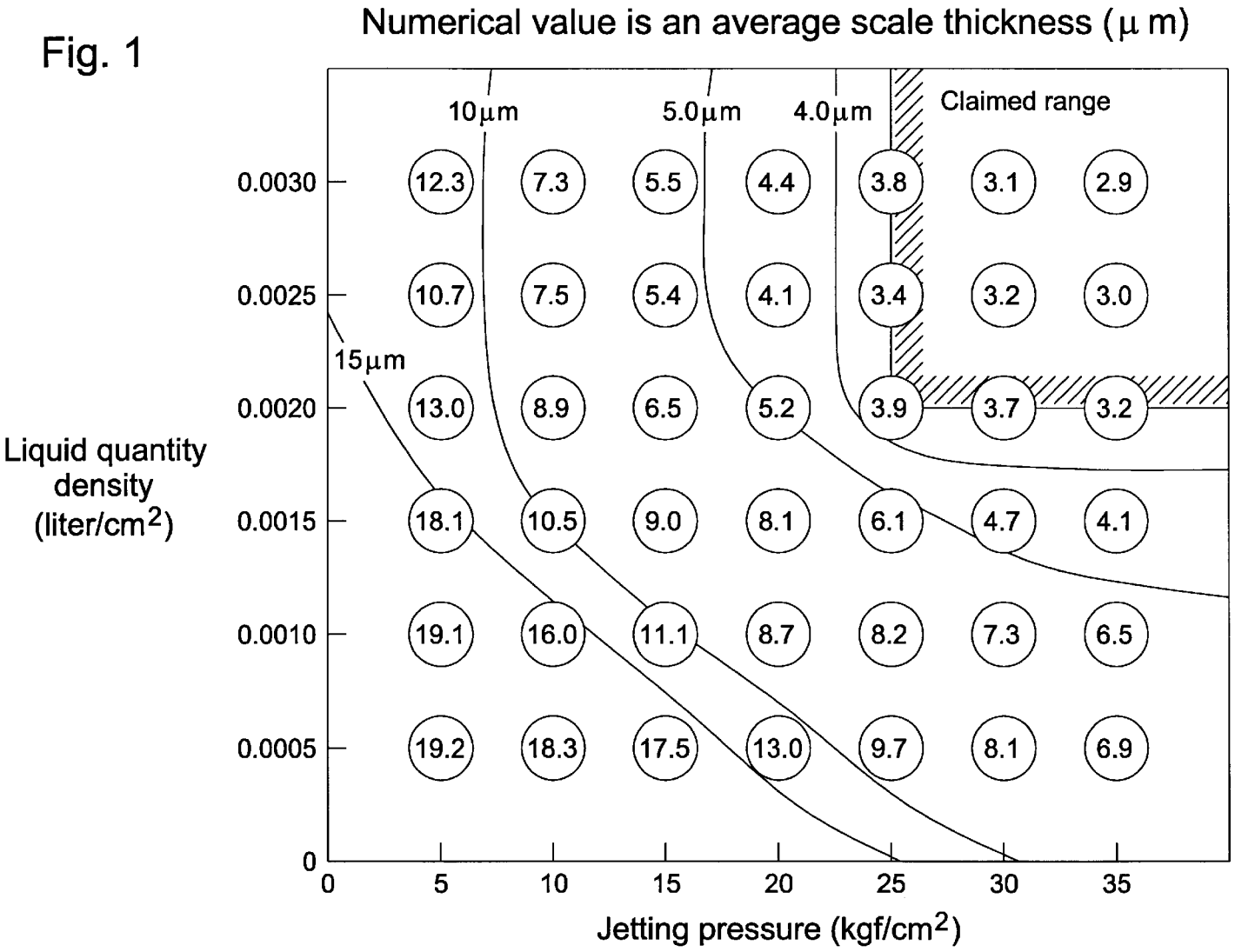
FIG. 1 is a graph showing a relation among jetting pressure, water amount and average scale thickness of hot rolled sheet.

Preferable conditions for carrying out the invention will be described below.

(1) As to steel components

C: 0.001–0.20 wt %

C is an element required for ensuring the strength. When the amount is less than 0.001 wt %, there is no effect of ensuring the strength, while when it exceeds 0.20 wt %, CO gas is generated at a boundary between scale and matrix to cause the peeling of scale in the course of the rolling resulting in scale flaw, so that the amount is 0.001–0.20 wt %, preferably 0.001–0.10 wt %.

Si: 0.01–0.50 wt %

Si is used for deoxidation and is an element for improving the strength. When the amount is less than 0.01 wt %, there is no effect, while when it exceeds 0.50 wt %, scale flaw such as red scale is apt to be caused, so that the amount is 0.01–0.50 wt %, preferably 0.01–0.2 wt %.

Mn: 0.05–2.0 wt %

Mn renders solid-soluted S resulting in the brittleness at hot work into harmless MnS and is an element effective for the improvement of the strength. When the amount is less than 0.05 wt %, there is no effect, while when it exceeds 2.0 wt %, the toughness is lowered, so that the amount is 0.05–2.0 wt %, preferably 0.05–1.0 wt %.

P: not more than 0.05 wt %

P badly exerts upon the grain boundary embrittlement and is desirable to decrease the amount as far as possible. When the P content exceeds 0.05 wt %, the bad influence is apt to be caused, so that it is not more than 0.05 wt %, preferably not more than 0.01 wt %. Moreover, when the amount is decreased to not more than 0.001 wt % under the present refining technique, the steel-making cost considerably increases, so that the lower limit is 0.001 wt % in view of economy.

S: not more than 0.05 wt %

S is an element degrading the hot workability and toughness. When the S content exceeds 0.05 wt %, the bad influence becomes conspicuous, it is not more than 0.05 wt %, preferably not more than 0.01 wt %. Moreover, when the amount is decreased to not more than 0.001 wt % under the present refining technique, the steel-making cost considerably increases, so that the lower limit is 0.001 wt % in view of economy.

sol.Al: 0.01–0.10 wt %

Al is an element added as a deoxidizing agent, if necessary. When the content is less than 0.01 wt % as sol.Al, there is no effect, while when it exceeds 0.10 wt %, not only the cost rises up but also the steel sheet is embrittled, so that the amount is 0.01–0.1 wt %. Moreover, it is preferably 0.04–0.1 wt % from a viewpoint of the cost performance.

N: not more than 0.020 wt %

N may be utilized for the strengthening by positive addition, but is an element embrittling the steel sheet when it is excessively included exceeding 0.020 wt %. Therefore, it is added within a range of not more than 0.020 wt %, if necessary. Particularly, if the strengthening is not required, the amount is preferably not more than 0.01 wt %. Moreover, when the amount is decreased to not more than 0.001 wt % under the present refining technique, the steel-making cost considerably increases, so that the lower limit is 0.001 wt % in view of economy.

Ti: not more than 0.10 wt %, Nb: not more than 0.10 wt %

Ti and Nb are elements forming carbon-nitrides, and are added for improving elongation and r-value through the reduction of solid solution C,N and increasing the strength through fine carbonitride. When each amount added exceeds 0.10 wt %, the peeling of scale is caused to bring about the occurrence of scale flaw, so that they are not more than 0.10 wt %. Moreover, the preferable addition amount is 0.01–0.06 wt %.

S: not more than 0.0100 wt %

B controls the grain boundary embrittlement produced when the total amount of solid solution C and N is decreased to not more than 0.0005 wt % and has an effect of enhancing the hardenability, and is an element in accordance with the necessity. However, when it is added in an amount exceeding 0.0100 wt %, the steel is hardened to cause embrittlement, so that the amount is not more than 0.0100 wt %. Moreover, the preferable addition amount is 0.0005–0.0030 wt %.

(2) As to production conditions;

a. The sufficient heating of the steel material before the hot rolling is sufficient to attain the complete solution, so that the heating may be carried out above $Ac_3$ point. Concretely, the usual slab heating temperature range of 1050°– 1300° C. is suitable.

b. Following to the above heating, there are carried out hot rough rolling, descaling with a super-high pressure water and hot finish rolling.

Among these steps, the particularly important features in the invention including limited reasons thereof will be described below.

At first, the reason why the rough rolling is completed at ($Ar_3$ point+100° C.)–($Ar_3$ point+50° C.) is due to the fact that the steel surface is partly transformed from γ to α in the subsequent descaling to soften the surface and provide a smooth surface and hence a surface roughness of Ra≦0.8 μm may be attained. That is, when the completion temperature of the rough rolling exceeds $Ar_3$ point+100° C., the surface layer is subjected to descaling at a state of γ region, so that the strength is high and the surface roughness of Ra: not more than 0.8 μm is not obtained. While, when it is lower than $Ar_3$ point+50° C., α-transformation proceeds in the descaling and the strength rather increases and hence the desired roughness can not be attained likewise the above.

In the thus obtained thin-scale steel sheet having a low surface roughness, it is possible to conduct the descaling in a very short time in the pickling and also the concentration of stress is controlled in the light plastic deformation to provide a very excellent adhesion property.

Figure 2:
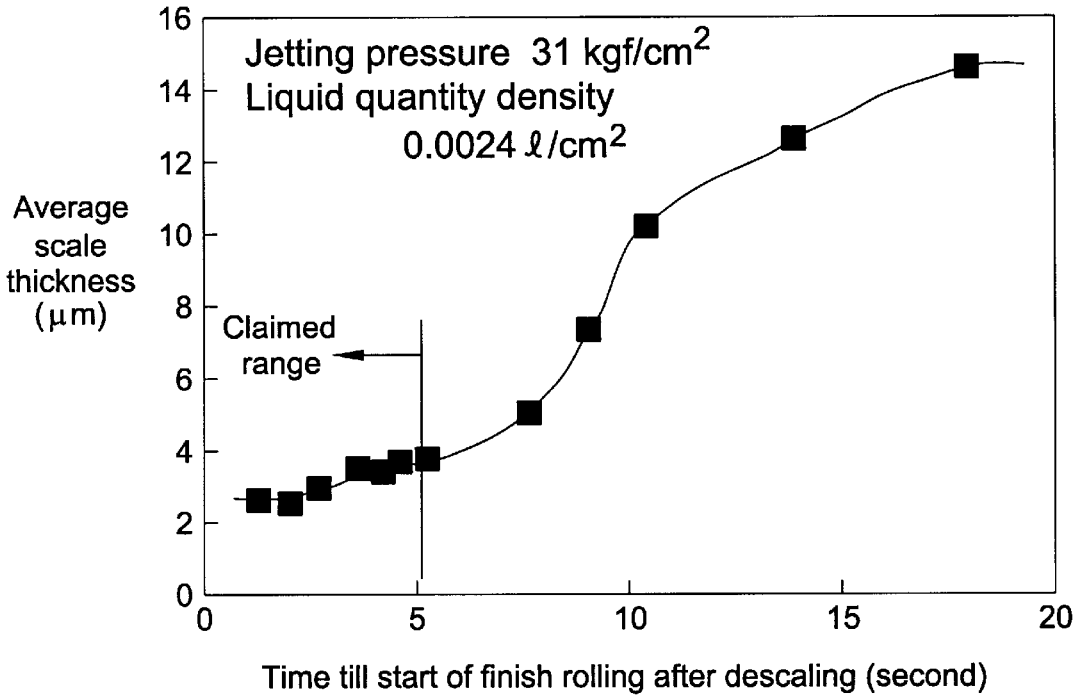
FIG. 2 is a graph showing a relation between lapse time starting finish rolling after descaling and average scale thickness of hot rolled sheet.

After the above rough rolling, the super-high pressure descaling and finish rolling are carried out. In this case, the conditions for such a super-high pressure descaling are required to have a jetting pressure on the surface of the steel sheet: not less than 25 kgf/cm$^2$ and a liquid quantity density: not less than 0.002 liter/cm$^2$ as shown in FIG. 1 and a time within 5 seconds till the finish rolling is started after the descaling as shown in FIG. 2 in order to control the average scale thickness to not less than 4 μm.

Here, the liquid quantity density is represented by a total liquid (water) quantity charged in the descaling per unit area of the steel sheet and determined by the following equation:

$$W=Q\cdot t/A \quad (1)$$

where

W: liquid quantity density (liter/cm$^2$)

Q: discharging quantity (liter/sec)

t: time retaining the steel sheet under spraying (sec)

A: spraying area jetted on the steel sheet (cm$^2$).

Moreover, the spraying area A jetted on the steel sheet (cm$^2$) and the time t retaining the steel sheet under spraying (sec) are determined by the following equation using a steel sheet velocity v (cm/sec), spray nozzle widening angle x (degree) and distance H from the spray nozzle to the steel sheet (cm).

When a shape of the spraying area A jetted on the steel sheet (cm$^2$) is a circle having a radius r, $$A=\pi r^2 \quad (2)$$

$$t=2r/v \quad (3)$$

Substituting for the equations (2) and (3), $$W=2Q/(\pi r\cdot v) \quad (4)$$

Further, $$r=H\cdot\tan(x/2) \quad (5),$$

so that adding the equation (5) to the equation (4), $$W=2Q/(\pi\cdot H\cdot\tan(x/2)\cdot v) \quad (6)$$

That is, the liquid quantity density W can be adjusted by the discharging quantity Q, steel sheet velocity v, spray nozzle widening angle x and distance H from the spray nozzle to the steel sheet.

These conclusions are obtained by the following experiment. The composition of steel to be used in the experiment is 0.03 wt % C-0.01 wt % Si-0.12 wt % Mn-0.004 wt % P-0.007 wt % S-0.05 wt % Al-0.003 wt % N. Furthermore, the slab thickness: 260 mm, the slab heating temperature: 1150° C., the rough rolling is 7 pass, the complete temperature: 930°–970° C. ($Ar_3$=870° C.), the sheet bar thickness is 40 mm, the finish rolling is 7 pass, the finish temperature: 875° C., the finish sheet thickness: 3.5 mm, and the coiling temperature is 610° C.

Furthermore, the scale thickness of the hot rolled steel sheet is calculated from weight difference before and after the pickling when a steel sheet punched out to 36 mmϕ is descaled by pickling with 20% hydrochloric acid (50° C.) and a specific gravity of scale is 5.2 g/cm$^3$. The positions of scale thickness to be measured are the vicinity of the center in the longitudinal direction of each steel band and ¼ thereof in the widthwise direction, and the scale thickness is an average of measured values at 5 positions.

Moreover, the jetting pressure p on the surface of the steel sheet in the descaling can generally be measured by the following equation from the discharging pressure P and quantity Q from the nozzle and the distance H between the surface of the steel sheet and the nozzle (see "Tetsu-to-Hagane", 1991, vol. 77, No. 9, page 1454, equation (4)):

$$p=5.64PQ/H^2 \quad (7)$$

where p: jetting pressure on the surface of the steel sheet (MPa)

P: discharging pressure (MPa)

Q: discharging quantity (liter/sec)

H: distance between steel sheet surface and nozzle (cm)

Although the mechanism of influencing the super-high pressure descaling conditions and the time until the start of finish rolling after the descaling upon the final scale thickness is not entirely clear in the invention, it is considered that as the jetting pressure is as super-high as 25 kg/cm$^2$, the unevenness of the surface layer is disappeared and smoothened to restrain the local formation of thick scale on the concave portion, and as the water quantity density exceeds 0.002 liter/cm$^2$, only the extreme surface layer is effectively cooled to considerably suppress the scale formation in about 5 seconds after the descaling. Further, it is considered that as a result of particularly controlling the rough rolling conditions in the invention, the steel sheet surface at the middle stage of the hot rolling is low in the roughness, then brings about the effect of controlling the growth of scale in the thickness direction.

Incidentally, the jetting pressure in the conventional high-pressure descaling is about 1.0–4.0 kgf/cm$^2$. In the invention, it seems that characteristic action and effect, which have never been expected in the conventional technique, are developed by adopting the super-high pressure corresponding to about 10 times of the above value.

In the finish rolling followed to the super-high pressure descaling, it is then required to coil below 700° C. at a rolling reduction of not less than 80% under condition that the rolling completion temperature is above $Ar_3$ point.

Because, when the rolling is carried out at lower than $Ar_3$ point, the rolled structure remains, or unfavorable structure is formed to degrade the properties, while when the rolling reduction of the finish rolling is less than 80%, the malleability of scale through rolling is insufficient and hence the thin scale is not attained. And also, when the coiling temperature exceeds 700° C., not only the growth of scale is conspicuous at the coil end portion after the coiling but also the crystal grain is abnormally coarsened to cause inconveniences such as the degradation of the properties and the like.

EXAMPLES

Example 1

A slab of steel containing C: 0.0025 wt %, Si: 0.01 wt %, Mn: 0.15 wt %, P: 0.009 wt %, S: 0.006 wt %, sol.Al: 0.05 wt % and N: 0.0027 wt % was heated to 1150° C., subjected to rough rolling at various temperatures shown in Table 1 to form a sheet bar of 35 mm, which was finish rolled at a reduction of 90% to a thickness of 3.5 mm and completed at a finish rolling temperature of 910° C. ($Ar_3$=910° C.). The coiling temperature was 550° C. In this case, the descaling conditions and the time up to the start of finish rolling after the descaling were varied as shown in Table 1. Moreover, the water discharging quantity Q, steel sheet velocity v, spray nozzle widening angle x and distance from spray nozzle to steel sheet H in the descaling were 1 liter/sec, 40 m/min, 40 degree and 10 cm as basic conditions, respectively. In order to obtain given liquid quantity density and jetting pressure, the discharging pressure P, water discharging quantity Q, steel sheet velocity v and distance from spray nozzle to steel sheet H were properly changed according to the equations (6) and (7).

After the resulting hot rolled steel sheet was cooled to room temperature, the average thickness of the scale was measured in the similar manner as described in FIGS. 1 and 2, while the surface roughness Ra was measured at a position corresponding to ¼ of the widthwise direction near to the center of the longitudinal direction of each steel sheet by every 5 positions in the longitudinal direction and widthwise direction to determine a surface roughness Ra from their weighted average. Furthermore, the pickling time was a time until the scale was completely peeled with 20% hydrochloric acid (50° C.). And also, it was cold rolled (rolling reduction 75%, thickness 0.7 mm) and annealed (continuous annealing at 800° C. for 60 seconds) and then the properties were measured. These results were shown in Table 1 together.

As seen from Table 1, the hot rolled steel sheets according to the invention had a thin scale having an average scale thickness of not more than 4 μm and a surface roughness Ra of not more than 0.8 μm and were good in not only the pickling property but also the properties after cold rolling.

TABLE 1

| Temperature in completion of rough rolling (°C.) | Descaling conditions: Discharge pressure (kgf/cm²) | Descaling conditions: Jetting pressure (kgf/cm²) | Descaling conditions: Water quantity density (l/cm²) | Time until start of finish rolling (second) | Surface roughness Ra (μm) | Properties of scale: Average scale thickness (μm0 | Pickling time (second) | Mechanical properties of cold rolled steel sheet: YS (kgf/mm²) | TS (kgf/mm²) | Elongation (%) | Average r-value | Remarks |
|---|---|---|---|---|---|---|---|---|---|---|---|---|
| 980 | 550 | 29.5 | 0.0024 | 2.3 | 0.62 | 3.5 | 35 | 16.3 | 30.7 | 49.1 | 1.78 | Invention Example |
| 995 | 620 | 33.3 | 0.0024 | 3.7 | 0.71 | 3.1 | 30 | 17.1 | 30.5 | 48.7 | 1.75 | |
| 965 | 600 | 32.2 | 0.0024 | 4.8 | 0.53 | 2.8 | 27 | 17.0 | 30.5 | 48.6 | 1.71 | |
| 940 | 500 | 26.8 | 0.0024 | 4.8 | 0.87 | 4.8 | 51 | 16.5 | 30.6 | 48.8 | 1.80 | Comparative Example |
| 1020 | 530 | 28.4 | 0.0024 | 5.0 | 1.03 | 5.0 | 63 | 16.7 | 30.5 | 49.5 | 1.83 | |
| 963 | 465 | 24.9 | 0.0025 | 4.2 | 1.25 | 7.3 | 108 | 16.5 | 30.4 | 48.9 | 1.75 | |
| 985 | 590 | 31.7 | 0.0018 | 2.9 | 0.91 | 5.5 | 72 | 17.0 | 30.3 | 48.8 | 1.78 | |
| 970 | 620 | 33.3 | 0.0020 | 3.3 | 0.78 | 3.5 | 45 | 16.8 | 31.0 | 49.5 | 1.78 | Invention Example |
| 970 | 600 | 32.2 | 0.0023 | 5.3 | 0.75 | 6.9 | 103 | 17.2 | 30.7 | 49.1 | 1.81 | Comparative Example |

Example 2

A slab of steel containing C: 0.08 wt %, Si: 0.01 wt %, Mn: 0.51 wt %, P: 0.011 wt %, S: 0.008 wt %, sol.Al: 0.04 wt % and N: 0.004 wt % was heated to 1200° C., subjected to rough rolling at various temperatures shown in Table 2 to form a sheet bar of 35 mm, which was then subjected to finish rolling at a reduction of 92% to a thickness of 2.8 mm and the finish rolling was completed at 875° C. ($Ar_3$point=850° C.). The coiling temperature was 610° C. In this case, the descaling conditions and the time until the start of the finish rolling after the descaling were changed as shown in Table 2.

After the resulting hot rolled steel sheet was cooled to room temperature, the scale thickness and surface roughness Ra (μm) were measured in the same manner as in Example 1. The results were also shown in Table 2. In this case, the pickling time was a time until the scale was completely peeled with 20% hydrochloric acid (50° C.).

As seen from Table 2, the hot rolled steel sheets produced according to the invention had an average scale thickness of not more than 4 μm and a surface roughness Ra of not more than 0.8 μm and were good in the pickling property.

TABLE 2

| Temperature in completion of rough rolling (°C.) | Descaling conditions: Discharge pressure (kgf/cm²) | Descaling conditions: Jetting pressure (kgf/cm²) | Descaling conditions: Water quantity density (l/cm²) | Time until start of finish rolling (second) | Surface roughness Ra (μm) | Properties of scale: Average scale thickness (μm) | Properties of scale: Pickling time (second) | Mechanical properties of hot rolled steel sheet: YS (kgf/mm²) | Mechanical properties of hot rolled steel sheet: TS (kgf/mm²) | Mechanical properties of hot rolled steel sheet: Elongation (%) | Remarks |
|---|---|---|---|---|---|---|---|---|---|---|---|
| 945 | 550 | 29.5 | 0.0024 | 2.3 | 0.61 | 3.5 | 36 | 24.7 | 36.5 | 47.5 | Invention Example |
| 940 | 620 | 33.3 | 0.0024 | 3.6 | 0.72 | 3.2 | 31 | 25.2 | 37.5 | 47.1 | |
| 925 | 600 | 32.2 | 0.0024 | 4.9 | 0.48 | 2.9 | 25 | 26.1 | 37.3 | 46.3 | |
| 890 | 500 | 26.8 | 0.0024 | 4.8 | 0.89 | 4.8 | 53 | 25.7 | 36.4 | 45.9 | Comparative Example |
| 980 | 530 | 28.4 | 0.0025 | 5.3 | 1.11 | 5.1 | 64 | 24.3 | 37.0 | 46.3 | |
| 945 | 460 | 24.7 | 0.0025 | 4.3 | 1.24 | 7.5 | 111 | 25.5 | 36.9 | 47.5 | |
| 955 | 590 | 31.7 | 0.0017 | 2.9 | 0.90 | 5.4 | 73 | 25.6 | 37.0 | 47.1 | |
| 950 | 620 | 33.3 | 0.0021 | 3.4 | 0.78 | 3.4 | 45 | 24.7 | 38.0 | 46.9 | Invention Example |
| 930 | 600 | 32.2 | 0.0023 | 5.5 | 0.74 | 6.8 | 105 | 26.4 | 37.7 | 46.2 | Comparative Example |
| 940 | 680 | 63.4 | 0.0028 | 3.2 | 0.62 | 2.7 | 24 | 26.5 | 39.5 | 47.2 | Invention Example |

Example 3

Each of steel slabs having a chemical composition shown in Table 3 was heated to 1200° C., rough rolled to a sheet bar of 35 mm, descaled, and subjected to finish rolling at a reduction of 90% to a thickness of 3.5 mm. The production conditions were summarized in Table 4.

After the resulting hot rolled steel sheet was cooled to room temperature, the scale thickness, surface roughness and pickling time were measured in the same manner as in Example 1. The results were also shown in Table 4.

As seen from Tables 3 and 4, the hot rolled steel sheets produced according to the invention had an average scale thickness of not more than 4 μm and a surface roughness not more than 0.8 μm and were good in the pickling property.

TABLE 3

| No | Chemical composition (wt %): C | Si | Mn | P | S | sol Al | N | Ti | Nb | B |
|---|---|---|---|---|---|---|---|---|---|---|
| 1 | 0.0027 | 0.46 | 1.20 | 0.060 | 0.006 | 0.05 | 0.0028 | 0.05 | — | 0.0026 |
| 2 | 0.0025 | 0.02 | 0.16 | 0.008 | 0.008 | 0.05 | 0.0025 | 0.06 | — | — |
| 3 | 0.0021 | 0.02 | 0.17 | 0.007 | 0.009 | 0.04 | 0.0031 | 0.05 | 0.006 | — |
| 4 | 0.0026 | 0.01 | 0.12 | 0.009 | 0.012 | 0.06 | 0.0032 | — | 0.04 | — |
| 5 | 0.0300 | 0.01 | 0.15 | 0.008 | 0.014 | 0.04 | 0.0027 | — | — | 0.0021 |
| 6 | 0.0027 | 0.01 | 0.14 | 0.006 | 0.008 | 0.07 | 0.0026 | 0.06 | — | 0.0011 |
| 7 | 0.0021 | 0.02 | 0.16 | 0.008 | 0.006 | 0.06 | 0.0028 | — | 0.03 | 0.0008 |
| 8 | 0.0019 | 0.01 | 0.15 | 0.008 | 0.008 | 0.05 | 0.0029 | 0.04 | 0.008 | 0.0012 |

TABLE 4

| No | Temperature in completion of rough rolling (°C.) | Descaling conditions: Discharge pressure (kgf/cm²) | Descaling conditions: Jetting pressure (kgf/cm²) | Descaling conditions: Water quantity density (l/cm²) | Time until start of finish rolling (second) | Finish rolling conditions: Complete temperature (°C.) | Finish rolling conditions: $Ar_3$ (°C.) | Coiling temperature (°C.) | Surface roughness Ra (μm) | Properties of scale: Average scale thickness (μm) | Properties of scale: Pickling time (second) | Remarks |
|---|---|---|---|---|---|---|---|---|---|---|---|---|
| 1 | 950 | 550 | 27.9 | 0.0024 | 4.1 | 910 | 880 | 630 | 0.62 | 3.9 | 46 | Invention Example |
| 2 | 970 | 540 | 27.1 | 0.0026 | 4.4 | 920 | 900 | 670 | 0.74 | 3.8 | 35 | |
| 3 | 960 | 600 | 30.1 | 0.0025 | 4.2 | 915 | 905 | 550 | 0.75 | 3.8 | 34 | |
| 4 | 980 | 620 | 31.1 | 0.0021 | 4.5 | 915 | 905 | 660 | 0.78 | 3.7 | 36 | |
| 5 | 930 | 610 | 30.6 | 0.0021 | 3.8 | 870 | 860 | 640 | 0.66 | 3.2 | 30 | |
| 6 | 950 | 580 | 29.1 | 0.0026 | 3.9 | 910 | 890 | 650 | 0.72 | 3.8 | 35 | |

TABLE 4-continued

| No | Temperature in completion of rough rolling (°C.) | Descaling conditions: Discharge pressure (kgf/cm²) | Jetting pressure (kgf/cm²) | Water quantity density (l/cm²) | Time until start of finish rolling (second) | Finish rolling conditions: Complete temperature (°C.) | $Ar_3$ (°C.) | Coiling temperature (°C.) | Surface roughness Ra (μm) | Properties of scale: Average scale thickness (μm) | Pickling time (second) | Remarks |
|---|---|---|---|---|---|---|---|---|---|---|---|---|
| 7 | 970 | 590 | 29.6 | 0.0021 | 4.2 | 915 | 900 | 630 | 0.70 | 3.7 | 32 | |
| 8 | 980 | 610 | 30.6 | 0.0027 | 3.6 | 925 | 910 | 600 | 0.63 | 3.6 | 33 | |

INDUSTRIAL APPLICABILITY

As mentioned above, the hot rolled steel sheets according to the invention are thin in the scale thickness, good in the adhesion property and very less in the peeling in applications that they are applied to working as-rolled (at a state of mill scale) and are good in the pickling property and have an excellent surface quality in applications used after the pickling.

According to the production method of the invention, the above hot rolled steel sheets can be produced very effectively by applying the super-high pressure descaling in the hot rolling step.

Therefore, the invention largely contributes to the productivity and economy of various products such as hot rolled steel sheets, cold rolled steel sheets using the hot rolled steel sheet as a starting material, surface-treated steel sheets and the like.

We claim:

1. A hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt % and the balance being Fe and inevitable impurities, and having an average surface scale thickness of not more than 4 μm and a surface roughness (Ra) of not more than 0.8 μm developed after rough rolling at a completing temperature of ($Ar_3$ point+100° C.)–($Ar_3$ point+50° C.) and super-high pressure descaling at a liquid quantity density of not less than 0.002 liter/cm² under a jetting pressure of not less than 25 kgf/cm² and then subsequent finish rolling.

2. A hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt %, one or two of Ti: not more than 0.10 wt % and Nb: not more than 0.10 wt % and the balance being Fe and inevitable impurities, and having an average surface scale thickness of not more than 4 μm and a surface roughness (Ra) of not more than 0.8 μm developed after rough rolling at a completing temperature of ($Ar_3$ point+100° C.)–($Ar_3$ point+50° C.) and super-high pressure descaling at a liquid quantity density of not less than 0.002 liter/cm² under a jetting pressure of not less than 25 kgf/cm² and then subsequent finish rolling.

3. A hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt %, B: not more than 0.0100 wt % and the balance being Fe and inevitable impurities, and having an average surface scale thickness of not more than 4 μm and a surface roughness (Ra) of not more than 0.8 μm developed after rough rolling at a completing temperature of ($Ar_3$ point+100° C.)–($Ar_3$ point+50° C.) and super-high pressure descaling at a liquid quantity density of not less than 0.002 liter/cm² under a jetting pressure of not less than 25 kgf/cm² and then subsequent finish rolling.

4. A hot rolled steel sheet comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt %, one or two of Ti: not more than 0.10 wt % and Nb: not more than 0.10 wt %, B: not more than 0.0100 wt % and the balance being Fe and inevitable impurities, and having an average surface scale thickness of not more than 4 μm and a surface roughness (Ra) of not more than 0.8 μm developed after rough rolling at a completing temperature of ($Ar_3$ point+100° C.)–($Ar_3$ point+50° C.) and super-high pressure descaling at a liquid quantity density of not less than 0.002 liter/cm² under a jetting pressure of not less than 25 kgf/cm² and then subsequent finish rolling.

5. A method of producing a hot rolled steel sheet, which comprises heating a starting material of steel comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt % and the balance being Fe and inevitable impurities to not lower than $Ac_3$ point, completing rough rolling within a temperature range of ($Ar_3$ point+100° C.)~($Ar_3$ point+50° C.), conducting super-high pressure descaling under conditions satisfying a jetting pressure of not less than 25 kgf/cm² and a liquid quantity density of not less than 0.002 liter/cm², starting finish rolling at a rolling reduction of not less than 80% above $Ar_3$ point of rolling complete temperature within 5 seconds and coiling up below 700° C.

6. A method of producing a hot rolled steel sheet, which comprises heating a starting material of steel comprising C: 0.001–0.20 wt %, Si: 0.01–0.50 wt %, Mn: 0.05–2.0 wt %, P: not more than 0.05 wt %, S: not more than 0.05 wt %, sol.Al: 0.01–0.10 wt %, N: not more than 0.020 wt %, one or more of Ti: not more than 0.10 wt %, Nb: not more than 0.10 wt % and B: not more than 0.0100 wt % and the balance being Fe and inevitable impurities to not lower than $Ac_3$ point, completing rough rolling within a temperature range of ($Ar_3$ point+100° C.)~($Ar_3$ point+50° C.), conducting super-high pressure descaling under conditions satisfying a jetting pressure of not less than 25 kgf/cm² and a liquid quantity density of not less than 0.002 liter/cm², starting finish rolling at a rolling reduction of not less than 80% above $Ar_3$ point of rolling complete temperature within 5 seconds and coiling up below 700° C.

* * * * *